US006813832B2

(12) United States Patent
Alexander

(10) Patent No.: US 6,813,832 B2
(45) **Date of Patent: *Nov. 9, 2004**

(54) SCISSORS TYPE IMPLEMENT FOR SECTIONING AND RETAINING A CANDLE WICK

(76) Inventor: Pamela K. Alexander, 11091 Hegel Rd., Goodrich, MI (US) 48438

( * ) Notice: Subject to any disclaimer, the term of this patent is extended or adjusted under 35 U.S.C. 154(b) by 0 days.

This patent is subject to a terminal disclaimer.

(21) Appl. No.: 10/365,372

(22) Filed: Feb. 12, 2003

(65) Prior Publication Data

US 2003/0172534 A1 Sep. 18, 2003

Related U.S. Application Data

(63) Continuation-in-part of application No. 10/098,962, filed on Mar. 15, 2002, now abandoned.

(51) Int. Cl.[7] ..... B25F 1/00; B26B 17/00; B26B 13/00

(52) U.S. Cl. ..... 30/124; 30/186; 30/233; 30/254; 30/179

(58) Field of Search ..... 30/90.1, 91.2, 30/124, 131, 179, 233, 254, 286, 287, 112, 191, 186; 431/120

(56) References Cited

U.S. PATENT DOCUMENTS

| | | | | | |
|---|---|---|---|---|---|
| 18,713 | A | * | 11/1857 | Stow et al. | 30/131 |
| 36,590 | A | * | 9/1862 | Eagle | 30/131 |
| 177,546 | A | * | 5/1876 | Nugent | 30/131 |
| 247,888 | A | * | 10/1881 | Clark | 431/120 |
| 249,818 | A | * | 11/1881 | Bailey | 30/131 |
| 496,407 | A | * | 5/1893 | Goldman | 30/131 |
| 601,943 | A | * | 4/1898 | Burke | 30/131 |
| 907,709 | A | * | 12/1908 | Adler | 30/112 |
| 920,822 | A | * | 5/1909 | Buckman | 431/120 |
| 997,261 | A | * | 7/1911 | Baum | 30/112 |
| 1,074,715 | A | * | 10/1913 | Hanson | 30/131 |
| 1,757,607 | A | * | 5/1930 | Zullo | 30/112 |
| 3,336,666 | A | * | 8/1967 | Calkin | 30/90.1 |
| 3,541,684 | A | | 11/1970 | Beaver | 30/124 |
| 3,854,202 | A | * | 12/1974 | Cortese et al. | 30/91.2 |
| 4,271,838 | A | | 6/1981 | Lasner et al. | 128/318 |
| 4,452,246 | A | | 6/1984 | Bader et al. | 128/340 |
| 4,656,741 | A | * | 4/1987 | Couture | 30/124 |
| 4,850,354 | A | | 7/1989 | McGurk-Burleson et al. | 128/305 |
| 5,016,353 | A | | 5/1991 | Iten | 30/124 |
| 5,711,075 | A | | 1/1998 | Wolf | 30/28 |
| 5,899,019 | A | | 5/1999 | Groves | 47/1.01 |
| 6,128,976 | A | * | 10/2000 | Tarpill | 81/423 |
| 6,142,955 | A | | 11/2000 | Farascioni et al. | 600/562 |
| 6,209,207 | B1 | | 4/2001 | Patterson et al. | 30/125 |
| 6,243,954 | B1 | | 6/2001 | Bowers | 30/233 |
| 6,321,453 | B1 | | 11/2001 | Pappas | 30/179 |
| 6,405,441 | B1 | | 6/2002 | Rucker | 30/179 |

* cited by examiner

*Primary Examiner*—Boyer D. Ashley
(74) *Attorney, Agent, or Firm*—Gifford, Krass, Groh, Sprinkle, Anderson & Citkowski, P.C.

(57) ABSTRACT

A scissor-type implement for use in removing a trailing end of a candle wick. The implement includes first and second elongated handle portions pivotally connected together at an intermediate location and each terminating in an opposing and inter engaging wick sectioning and storage member. A first of the wick sectioning and storage members includes a substantially bell shaped and interiorly hollowed housing exhibiting a base surface with a razor edge. A second of the wick sectioning and storage members also including a substantially bell shaped and interiorly hollowed housing exhibiting a base surface with a flattened support edge. Upon the housing members first being partially displaced relative one another and arrayed around the wick, the handle portions are actuated in mating fashion so that the razor edge of the first member is matingly adhered to the support edge of the second support member to successively grip the wick and section its trailing end from a remaining portion of the wick, the sectioned wick end being retained within an enclosure defined between the members.

9 Claims, 2 Drawing Sheets

SCISSORS TYPE IMPLEMENT FOR SECTIONING AND RETAINING A CANDLE WICK

CROSS REFERENCE TO RELATED APPLICATIONS

The present application is a continuation-in-part of U.S. application Ser. No. 10/098,962, filed Mar 15, 2002 now abandoned, and entitled Scissors Type Element for Sectioning and Retaining a Candle Wick.

BACKGROUND OF THE INVENTION

1. Field of the Invention

The present invention relates generally to candle wick trimming devices. More particularly, the present invention discloses an improved and modified version of a scissor-type wick trimming implement disclosed in U.S. Ser. No. 10/098,962 and which again exhibits bell-shaped opposing and inter-engaging portions for successively sectioning and retaining a candle wick. In particular, the present invention is uniquely suited to re-fashion a desired trailing length (typically ¼") of a candle wick, both new as well as recessed inside a partially melted candle, such a wick usually further exhibiting a straight edge after sectioning.

2. Description of the Prior Art

The prior art is fairly well documented with prior art examples of wick trimming devices. The objective in each instance is to substitute the use of scissors, tweezers or other known implements with a device more particularly suited for sectioning a new or partially burnt candle wick to retain a desired remaining length of the wick for subsequent relighting of the candle. In the particular instance of scissors, it has typically found that they have to be angled in order to section a trailing end of the candle wick and, given further the degree to which the wick may be recessed within a previously burnt candle, adequate sectioning of the wick is often difficult to accomplish.

A first example of the prior art is illustrated in U.S. Pat. No. 6,243,954, issued to Bowers, and teaches a wick trimming device incorporating a pair of elongated jaw members extending from scissor shaped handle portions. Cooperating severing surfaces are arranged in spaced fashion from the lower ends for severing the candle wick a predetermined height above the candle. The severing surfaces include a pair of opposing recesses defined between the jaw members, for receiving and retaining the extending candle wick, as well as an inwardly directed and tapered severing shelf disposed above one of the selected and recessed vertical faces.

U.S. Pat. No. 6,321,453, issued to Pappas, teaches a wick trimmer which, referring in particular to the second variant of FIGS. 12–17, includes blades, arms, and an engaging pivot for rotatably securing the arms together. In the further variant of FIG. 17, the second plate is replaced by an anvil. Also illustrated are gauge fingers and which (referring to the further variant of FIGS. 15 and 16) may be rotatably attached to the wick trimming device. As further explained, the gauge finger rests on the wax surface of a candle and so that the wick of the candle passes between the blades prior to being sectioned.

Finally, U.S. Pat. No. 6,209,207, issued to Patterson, teaches a hand held candle wick cutting device which includes a main outer tube and an inner tube with an outer diameter slightly smaller than the inner diameter of the outer tube and so that the inner tube is rotatably installed within the outer tube. A pair of cutting blades are mounted to the outer and inner tubes in perpendicular fashion relative and along the longitudinal axis and so that, upon rotating the tubes relative to one another, an inserted candle wick is severed and retained within the inner tube for subsequent removal and disposal.

SUMMARY OF THE PRESENT INVENTION

The present invention is a scissor-type wick trimming implement which exhibits bell-shaped opposing and inter-engaging portions for successively sectioning and retaining a candle wick. In particular, and as previously explained, the present invention is uniquely suited to re-fashion a desired trailing length (typically ¼") of a candle wick recessed inside a partially melted candle, such a wick usually further exhibiting a straight edge after sectioning.

The scissor-type implement includes first and second elongated handle portions, each of the handle portions having a looped scissor end and being pivotally connected together at an intermediate location by such as a stainless steel pin or other suitable fastener to permit pivoting of the first and second elongated portions. The handle portions each further terminate in an opposing and inter engaging wick sectioning and storage member.

Each of the wick sectioning and storage members further includes a substantially semi-spherical shaped and interiorly hollowed housing. In particular, the semi-spherical shape may further include a substantially arcuate and bell shaped configuration. A first of the semi-spherical shaped housings includes a recessed base surface terminating in a blade edge; whereas a second of the semi-spherical shaped housings includes an aligning base surface terminating in a substantially flattened and support edge against which is contacted the blade edge upon closing of the sectioning and storage members.

In a preferred embodiment, the blade edge is provided as a removable razor blade having a semi-circular configuration and which is seated against an end face of a downwardly projecting sleeve inside the associated bell housing. A screw inserts through an aperture in the blade and threadably engages the projecting sleeve to secure the blade in its recessed location within the bell housing. The other and aligning base surface with the flattened support edge may be integrally formed with the second bell shaped housing.

In use, the housing members are initially partially displaced relative one another and arrayed around the wick. The handle portions are then actuated in mating fashion, such that the blade edge of the first housing and the mating and aligning support edge of the second housing sandwich therebetween the wick, its trailing end of which is successively sectioned in straight edged fashion from a remaining upstanding portion of the wick, the dimensions of which in one preferred embodiment are again preferably in the range of ¼".

The sectioned wick end is retained within the enclosure defined by the mating housing members and during subsequent retraction and removal from such as a recessed location within which the candle may be situated. It has also been found that an angularly incised end of the remaining candle wick, in use, produces an improved and more aesthetically appealing flame.

BRIEF DESCRIPTION OF THE DRAWINGS

Reference will now be had to the attached drawings, when read in combination with the following detailed description, wherein like reference numerals refer to like parts throughout the several views, and in which.

DESCRIPTION OF THE PREFERRED EMBODIMENT

Figure 1:
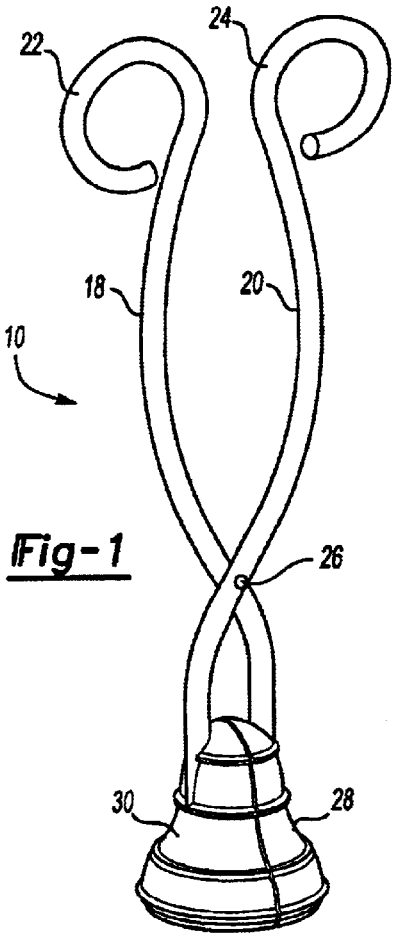
FIG. 1 is a perspective view of the scissor-type implement according to a preferred embodiment of the present invention.
Figure 2:
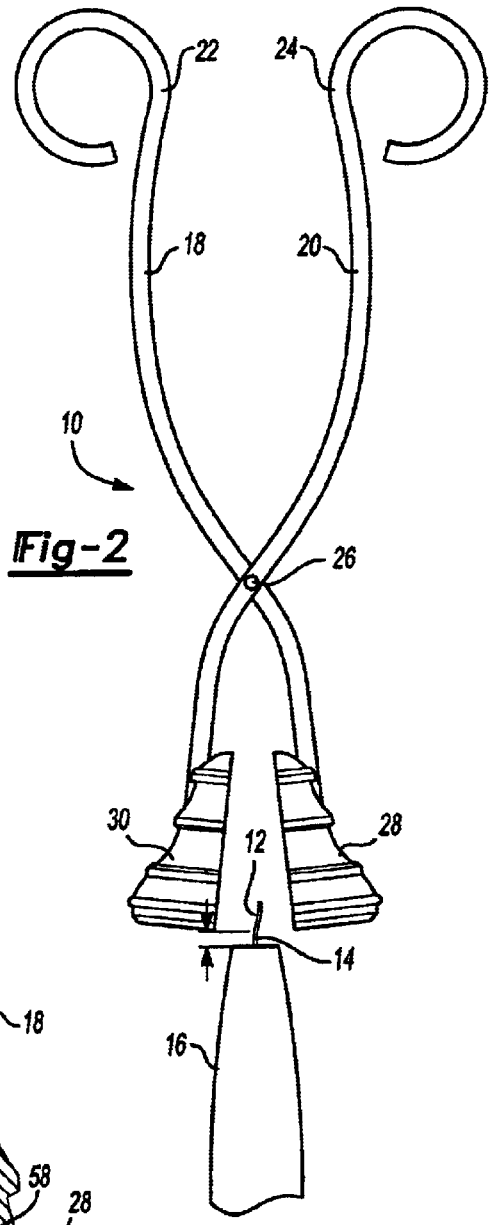
FIG. 2 is a plan view of the scissor-type implement as shown in FIG. 1 and illustrating the substantially bell shaped and interiorly hollowed housings in a partially opened and arrayed position about an un-sectioned candle wick.
Figure 3:
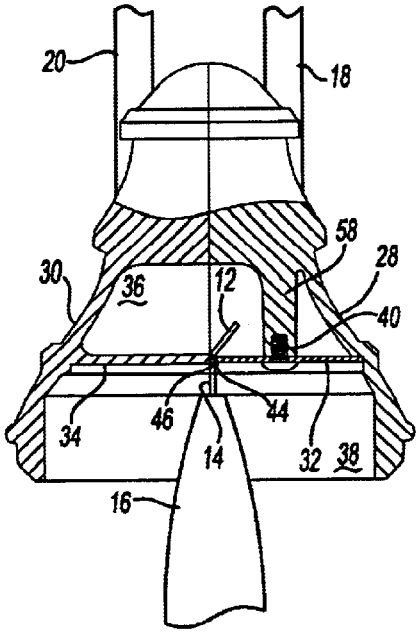
FIG. 3 is an enlarged and partial cutaway view of the bell shaped housings of FIG. 2 and illustrating the manner in which the angled blade edge and opposing and abutting support edge sandwich therebetween the wick to be sectioned.

Referring now to FIGS. 1 and 2, a scissor-type implement is illustrated at 10 according to a preferred embodiment of the present invention and which is useful in removing a trailing end 12 of an existing candle wick 14 (see also FIGS. 2 and 3). In particular, and as previously explained, the present invention is uniquely suited to re-fashion a desired trailing length (typically ¼") of a candle wick recessed inside a partially melted candle (the candle also being referenced at 16 in FIGS. 2 and 3), the wick 12 usually further exhibiting a desired straight edge sectioning (again FIG. 3).

As also previously explained, the implement 10 of the present invention makes possible the sectioning of an excessive length of a wick and in which the candle is situated in a recessed manner, such as within a tall glass enclosure or the like. It has also been found that a straight cut edge of the remaining candle wick, in use, produces an improved and more aesthetically appealing flame.

Referring again to FIGS. 1 and 2, the scissor-type implement includes a first 18 and a second 20 elongated handle portion. Each of the handle portions 18 and 20 is constructed of a suitable material, such as a machined brass or other suitable metal exhibiting properties of durability and heat resistance. Each of the handle portions 18 and 20 further includes a looped scissor end, see at 22 and 24 respectively for handle portions 18 and 20.

The handle portions 18 and 20 are further pivotally connected together at an intermediate location and, as illustrated, this is accomplished by such as a stainless steel pin 26 or other suitable fastener, which inserts through aligning apertures defined in the handle portions 18 and 20 and which permits pivoting of the elongated handle portions about a generally centrally defined axis extending through the pin 26. As is again evidenced by the designations 18 and 20 for the handle portions, each further includes a somewhat widened intermediate portion at its pivotally securing location, this permitting the proper dimensioning of the wick sectioning and retaining portions as will now be described.

Figure 4:
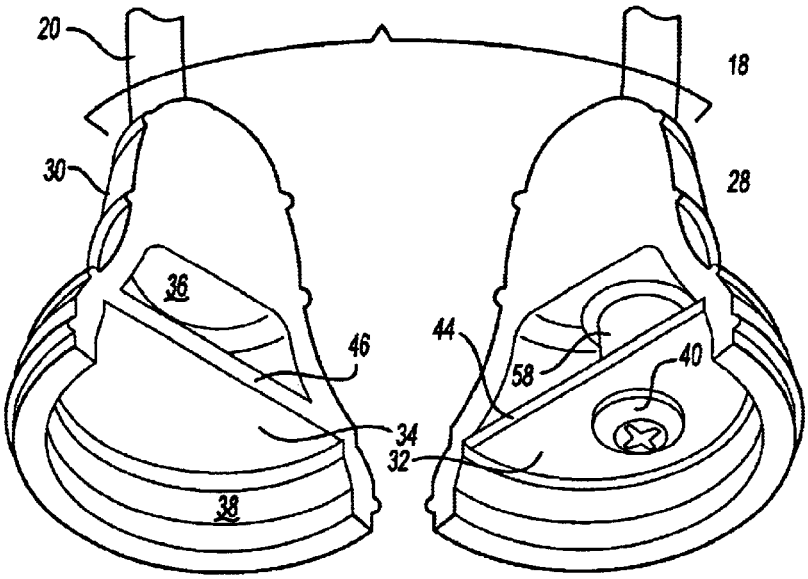
FIG. 4 is a partially exploded view illustrating, in end face perspective, the configuration of each opposing face of the first and second bell shaped housings.
Figure 5:
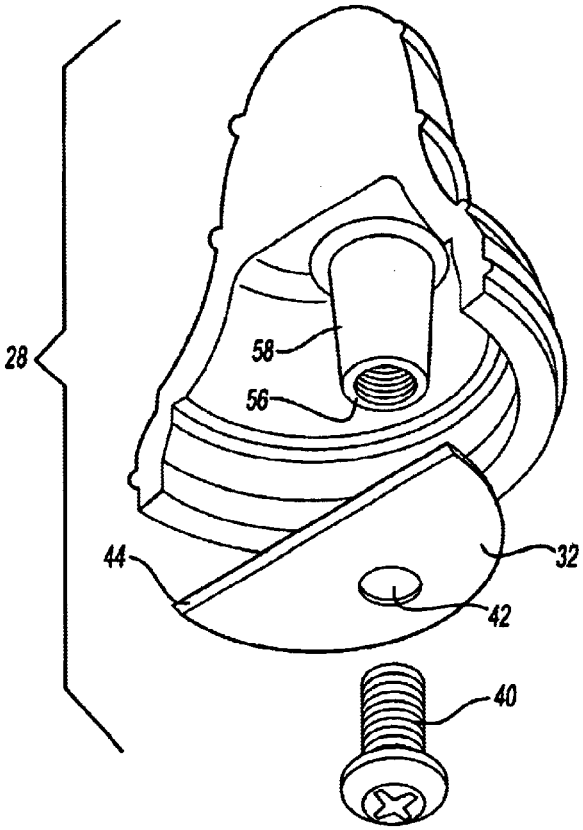
FIG. 5 is a further enlarged view in exploded perspective of the first bell-shaped housing and illustrating the replaceable nature of the blade edge portion.

As also illustrated in each of FIGS. 3, 4 and 5, the handle portions 18 and 20 each further terminate, at an end opposite the associated looped scissor ends 22 and 24, in an opposing and inter engaging wick sectioning and storage member. In a preferred illustrated variant, each of the wick sectioning and storage members is further defined by a substantially semi spherical shaped and interiorly hollowed housing, and reference is made to first housing 28 associated with the first handle portion 18 and second housing 30 associated with the second handle portion 20.

Each of the first and second housings 28 and 30 include a semispherical, and preferably substantially arcuate and bell shaped, configuration and which further defines an open and substantially hollow interior. As also best illustrated in FIGS. 3 and 4, a base surface, see at 32 and 34, is provided for each of the housings 28 and 30 and is recessed inwardly a desired distance from a bottom location of each of the housings. Upon the three dimensional and bell shape of the housings 28 and 30 being matingly engaged together, as best shown in the cutaway of FIG. 3, it defines a first and upper enclosed interior 36 and a second and lower open interior 38.

As is best shown in FIG. 5, the recessed base surface 32 associated with the first 28 of the semi-spherical shaped housings is provided as a removable razor blade having a semi-circular configuration and which is seated against an end face 56 of a downwardly projecting sleeve 58 inside the associated bell housing 28. A screw 40 inserts through an aperture 42 in the blade 32 and threadably engages an interior of the projecting sleeve (recessed within the end face 56) to secure the blade 32 in its recessed location within the bell housing 28 and further such that a sharpened blade edge 44 is exhibited along an exposed face of the housing.

The other and aligning base surface 34 (associated with the second bell shaped housing 30) exhibits a flattened support edge 46 and may be integrally formed with the second bell shaped housing. The aligning base surface 34 with substantially flattened and support edge 46 contacts the blade edge 44 upon closing of the sectioning and storage members and as is best illustrated again in FIG. 3.

In use, and as is best initially shown in FIG. 2, the housing members 28 and 30 are initially partially displaced relative one another and arrayed around the wick 14. The handle portions 18 and 20 are then actuated in mating fashion, such that the blade edge 44 of the first housing 28 and the mating and aligning support edge 46 of the second housing 30 sandwich therebetween the wick 14, its trailing end 12 being successively sectioned in straight edged fashion from the remaining and upstanding portion of the wick, the dimensions of which in one preferred embodiment are again in the range of ¼".

As is again best shown in FIG. 3, the sectioned wick end 12 is retained within the enclosure 36 defined by the mating housing members and during subsequent retraction and removal (also from such as a recessed location within which the candle may be situated). It has also been found that a straight incised end of the remaining candle wick, in use, produces an improved and more aesthetically appealing flame. In this manner, the sectioned wick end 12 is retained within the enclosure defined by the mating housing members and is prevented from falling into the candle and such as in particular its upper melted wax layer.

Having described my invention, additional preferred embodiments will become apparent to those skilled in the art to which it pertains and without deviating from the scope of the appended claims. In particular, and without limitation, the three dimensional housing members, with retained incisor portions, may be shaped in any suitable and enclosing fashion for accomplishing sectioning and retaining of the sectioned wick end.

I claim:

1. A scissor-type implement for use in removing a trailing end of a candle wick, said implement comprising:

first and second elongated handle portions pivotally connected together at an intermediate location;

each of said handle portions terminating in an opposing and inter engaging wick sectioning and storage member, a first of said members including a base surface exhibiting a blade edge, a second of said members including a base surface exhibiting a support edge arrayed in opposing and matingly engageable fashion relative said blade edge; and upon said members being partially displaced relative one another and arrayed around the wick, said handle portions being actuated to interengage said members and in order to successively grip, section and retain the wick trailing end within an enclosed volume defined by said associated base surfaces and a substantially three-dimensional hollowed interior established between said interengaged members.

2. The scissor-type implement as described in claim 1, said second wick sectioning and storage member further exhibiting an integrally formed base surface with a flattened support edge.

3. The scissor-type implement as described in claim 1, further comprising a stainless steel pin for pivotally securing together said first and second elongated handle portions.

4. The scissor-type implement as described in claim 1, each of said wick sectioning and storage members further comprising a substantially semi spherical shaped and interiorly hollowed housing.

5. The scissor-type implement as described in claim 4, each of said semi-spherical shaped members having a selected shape and size and further comprising a substantially arcuate and bell shape configuration.

6. The scissor-type implement as described in claim 1, said base surface associated with said first wick sectioning and storage member further comprising a removable razor blade.

7. The scissor-type implement as described in claim 6, further comprising a downwardly projecting and internally threaded sleeve integrally defined with said first member, a screw inserting through an aperture defined in said razor blade and rotatably engageable with said sleeve to secure said razor blade to said first member.

8. A scissor-type implement for use in removing a trailing end of a candle wick, said implement comprising:

first and second elongated handle portions pivotally connected together at an intermediate location, each of said handle portions terminating in an opposing and inter engaging wick sectioning and storage member, each of said wick sectioning and storage members further comprising a substantially semi spherical shaped and interiorly hollowed housing;

a removable blade exhibiting a razor edge extending from said substantially hollowed interior of said first member and in a direction towards a mating surface exhibiting a flattened support edge extending from said substantially hollowed interior of said second member; and upon said members being partially displaced relative one another and arrayed around the wick, said handle portions being actuated in mating fashion such that said razor edge abuts said flattened support edge to successively grip the wick and section its trailing end from a remaining portion of the wick, the sectioned wick end being retained within an enclosed volume defined by said abutting blade edge and mating surface and a three-dimensional hollowed interior established between said members.

9. A scissor-type implement for use in removing a trailing end of a candle wick, said implement comprising:

first and second elongated handle portions pivotally connected together at an intermediate location, each of said handle portions terminating in an opposing and inter engaging wick sectioning and storage member, each of said wick sectioning and storage members further comprising a substantially semi-bell shaped and interiorly hollowed housing;

a removable blade exhibiting a razor edge extending from said substantially hollowed interior of said first member, a screw inserting through an aperture in said blade and engaging an inwardly threaded and downwardly projecting sleeve integrally defined with said first member and in a direction towards a mating surface exhibiting a flattened support edge extending from said substantially hollowed interior of said second member; and upon said members being partially displaced relative one another and arrayed around the wick, said handle portions being actuated in mating fashion such that said razor edge abuts said flattened support edge to successively grip the wick and section its trailing end from a remaining portion of the wick, the sectioned end being retained within an enclosed volume defined by said abutting blade edge and mating surface and a three-dimensional hollowed interior established between said members.

* * * * *